US005619583A

United States Patent [19]

Page et al.

[11] Patent Number: 5,619,583

[45] Date of Patent: Apr. 8, 1997

[54] APPARATUS AND METHODS FOR DETERMINING THE RELATIVE DISPLACEMENT OF AN OBJECT

[75] Inventors: Steven L. Page; James Hollander, both of Dallas; Gene Frantz, Missouri City, all of Tex.

[73] Assignee: Texas Instruments Incorporated, Dallas, Tex.

[21] Appl. No.: 475,249

[22] Filed: Jun. 7, 1995

Related U.S. Application Data

[62] Division of Ser. No. 837,291, Feb. 14, 1992.

[51] Int. Cl.[6] ..... H04R 25/00

[52] U.S. Cl. ..... 381/172; 381/168; 359/149

[58] Field of Search ..... 381/172, 170, 381/168, 171, 160, 177, 119; 359/149, 150

[56] References Cited

U.S. PATENT DOCUMENTS

| | | | |
|---|---|---|---|
| 3,286,032 | 11/1966 | Baum | 381/172 |
| 3,580,082 | 5/1971 | Strack . | |
| 3,622,791 | 11/1970 | Bernard | 381/172 |
| 4,016,556 | 4/1977 | Fulenwider | 381/172 |
| 4,422,182 | 12/1983 | Kenjo | 381/172 |
| 4,993,073 | 2/1991 | Sparkes . | |
| 5,014,341 | 5/1991 | Bittel . | |

*Primary Examiner*—Curtis Kuntz
*Assistant Examiner*—Huyen D. Le
*Attorney, Agent, or Firm*—Gerald E. Laws; C. Alan McClure; James C. Kesterson

[57] ABSTRACT

A microphone is disclosed which converts an audio signal directly into a digital representation by analyzing and digitizing the distortion imposed upon a signal, such as a string of regularly spaced pulses as a result of the displacement of a diaphragm, relative to a sensor, in response to the incoming acoustical signal. Other devices, systems and methods are also disclosed.

3 Claims, 5 Drawing Sheets

| PULSE PATTERN | ASSOCIATED ADDRESS |
|---|---|
| 1 0 0 0 1 0 0 0 1 0 0 0 1 | A 1 0 0 |
| 1 1 0 0 1 1 0 0 1 1 0 0 1 | A 1 0 0 |
| 1 0 0 1 0 0 1 0 0 1 0 0 1 | A 1 0 1 |

150

| MEMORY ADDRESS | DATA |
|---|---|
| A 9 9 0 | -1 |
| A 1 0 0 | 0 |
| A 1 0 1 | +1 |

143

APPARATUS AND METHODS FOR DETERMINING THE RELATIVE DISPLACEMENT OF AN OBJECT

This is a division of application Ser. No. 07/837,291, filed Feb. 14, 1992.

FIELD OF THE INVENTION

This invention generally relates to sensors, microphones, sensor systems and methods.

BACKGROUND OF THE INVENTION

Without limiting the scope of the invention, its background is described in connection with microphones, as an example.

Heretofore, in this field, acoustical signals have been converted into analog electrical signals and fed to an electronic amplifier. The processing of analog signals introduces distortion. Conversion of analog signals to digital form also introduces distortion. Acoustic and mechanical distortion and analog noise in recording also can disadvantageously occur.

Accordingly, improvements which overcome any or all of the problems are presently desirable.

SUMMARY OF THE INVENTION

Generally, and in one form of the invention, a microphone for converting an acoustic signal directly into a digital signal representing the audio signal is disclosed. The microphone includes a diaphragm flexibly mounted to a base so as to be displaced when sound waves impinge upon the diaphragm. The microphone also includes a signal source for providing a known signal and means for distorting or deliberately altering the signal in response to the displacement of the diaphragm. Also included is a processor for receiving the distorted or deliberately altered signal and determining the amount of displacement of the diaphragm from the degree of distortion or alteration of the signal.

An advantage of the invention is that by converting the acoustical signal directly into a digital signal the distortion that results from processing an analog signal is avoided as is the distortion that results from converting from an analog to a digital signal.

BRIEF DESCRIPTION OF THE DRAWINGS

In the drawings.

Corresponding numerals and symbols in the different figures refer to corresponding parts unless otherwise indicated.

DETAILED DESCRIPTION OF PREFERRED EMBODIMENTS

Figure 1:
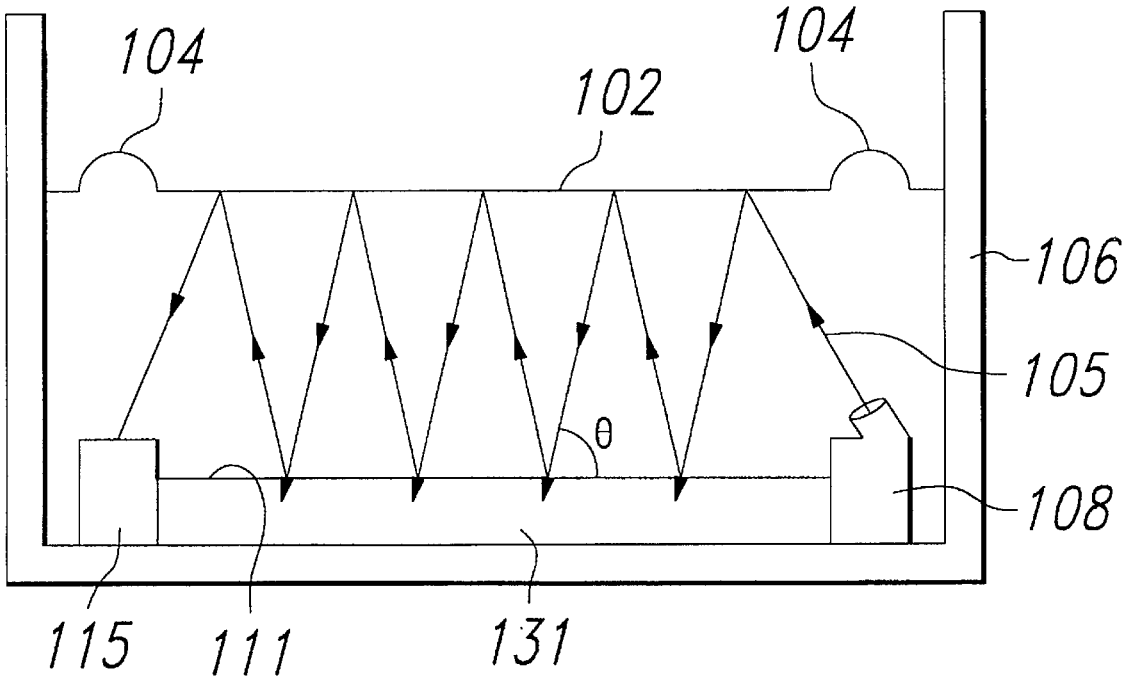
FIG. 1 is a cross-section of a first preferred embodiment microphone.

In FIG. 1 diaphragm 102 is flexibly mounted onto base 106 by flexible mounting members 104. Light beam 105 from light source 108 is directed to shine upon diaphragm 102. Diaphragm 102 is reflective so light beam 105 is reflected from diaphragm 102 onto mirror surface 111. Surface 111 is also reflective, so light beam 105 bounces back and forth between diaphragm 102 and mirror surface 111 until finally being absorbed by absorber 115.

Figure 2:
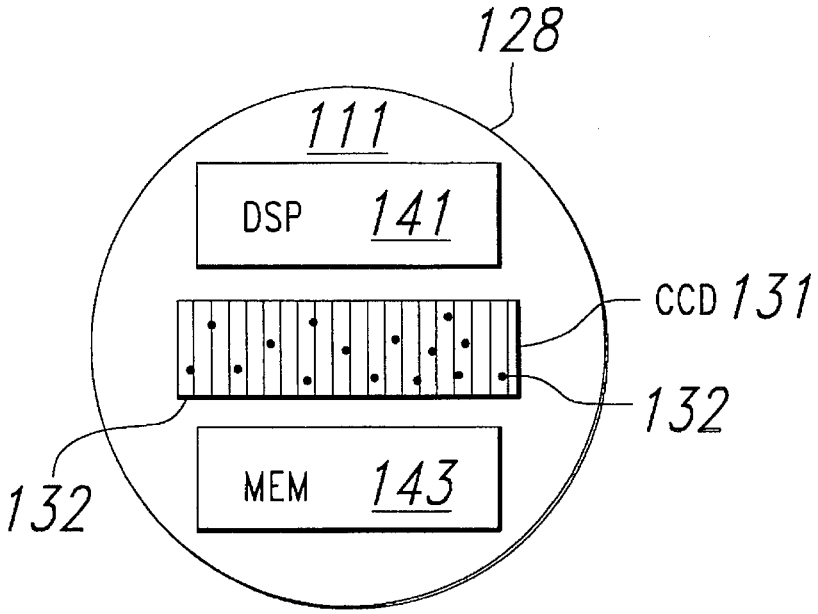
FIG. 2 is a plan view and block diagram of a sensor DSP and memory of the first preferred embodiment of FIG. 1.

A portion of light beam 105 also passes through mirror surface 111 and impinges upon sensor 131, which is advantageously a charge coupled device comprising a series of sensing elements, as illustrated in FIG. 2. Sensor 131 outputs a digital pulse pattern which corresponds to the position of light hitting it, as explained below. Mirror surface 111 is advantageously a reflective passivation layer provided on semiconductor chip 128. Charge coupled device sensor 131, digital signal processor (DSP) 141, and memory 143 are fabricated on semiconductor chip 128, and then mirror surface 111 is deposited on the resulting integrated circuit.

Figures 3, 4:
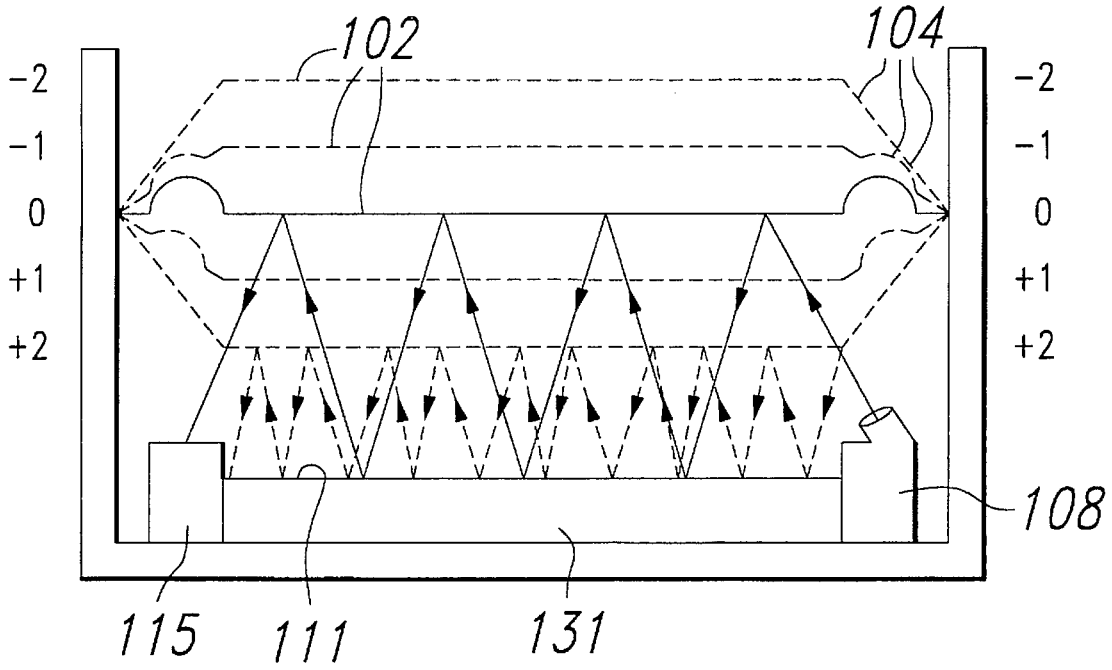
FIG. 3 is another cross-section diagram of the first preferred embodiment microphone.
FIG. 4 is a block diagram of a portion of the DSP and memory of the first preferred embodiment microphone of FIG. 1.

When diaphragm 102 is at rest in its initial or unextended position, as shown in FIG. 1 and also in FIG. 3 as position 0, light beam 105 hits and reflects from diaphragm 102 and mirror surface 111 at an angle theta. This results in the portion of light beam 105 which passes through mirror surface 111 impinging upon sensor 131 with uniform spacing, resulting in a uniform pattern of equally spaced pulses from sensor 131. Advantageously, the at rest position of diaphragm 102 results in a pattern of pulses from sensor 131 such as 1000100010001. The digital one pulses result from those sensing elements 132 of sensor 131 wherein light beam 105 strikes, and the zero pulses result from those sensing elements 132 of sensor 131 wherein no light strikes. Other possible positions diaphragm 102 assumes in response to sound waves hitting the diaphragm and causing it to vibrate are illustrated by dotted lines in FIG. 3 and referenced as position 1, 2, −1, −2. Note that regardless of the position of diaphragm 102, flexible mounting members 104 allow it to remain substantially parallel to mirror surface 111. This means that the angle theta of incidence and reflection of light beam 105 remains constant; however, because of the change in distance between diaphragm 102 and mirror surface 111, light beam 105 hits sensor 131 with different spacings, depending on the position of diaphragm 102. This results in different patterns of pulses from sensor 131 corresponding to the different positions of diaphragm 102. For example, the pattern corresponding to diaphragm 102 being at position 0 in FIG. 3 is 1000100010001. At position 1, however, the pattern is 1001001001001, and at position +2, the pattern is 1010101010101. These exemplary patterns illustrate that the closer diaphragm 102 is to mirror surface 111, the closer the points at which light beam 105 impinges upon sensor 131, and thus the closer the ones of the pulse pattern. Similarly, at position −1, the pattern of pulses from sensor 131 is 1000010000100001, and at position −2, the pattern is 1000001000001, corresponding to the increased distance between diaphragm 102 and mirror surface 111.

In FIG. 3, light beam 105 is shown for the situation where diaphragm 102 is at position 0 and +2. Light beam 105 is not shown for the other illustrated positions of diaphragm 102 for the sake of clarity. Note that the illustrated possible positions of diaphragm 102, −2, −1, 0, +1 and +2, are merely illustrative. Diaphragm 102 can occupy an infinite number of possible positions. The resolution or accuracy with which the location of diaphragm 102 can be sensed is limited only by the resolution of sensor 131 and of DSP 141. These elements can be made suitably accurate to readily provide more than sufficient resolution.

In a first circuit arrangement, the pulse pattern output is fed directly as addresses to memory 143 which retrieves displacement information from an addressed memory location. The displacement information is returned and fed from memory 143 to DSP 141 for filtering, storage and output. DSP 141 has instruction memory and RAM, and circuitry for executing digital signal processing algorithms. An exemplary DSP for any of the embodiments is a chip from any of the TMS320 family generations from Texas Instruments Incorporated, as disclosed in co-assigned U.S. Pat. Nos. 4,577,282; 4,912,636, and 5,072,418, each of which patents is hereby incorporated herein by reference. Filtering and the other algorithms for the DSP are disclosed in *Digital Signal Processing Applications with the TMS*320 *Family: Theory, Algorithms and Implementations, Texas Instruments,* 1986 which is also hereby incorporated herein by reference. See, for instance, Chapter 3 therein. DSP interface techniques are described in this application book also.

In a second circuit arrangement, the pulse pattern output is fed directly to DSP 141 which has onboard memory for DSP instructions and displacement information. DSP 141 converts the pulse patterns to addresses by counting one-bits in the pulse patterns for instance. The addresses resulting from processing are used for look-up purposes or alternatively fed to a displacement calculating algorithm. The displacement information then is digitally filtered.

In a third circuit arrangement, the pulse pattern output by sensor 131 is fed to DSP 141. DSP 141 advantageously includes look-up table 150 which has memory addresses corresponding to the possible pulse patterns output by sensor 131. The memory addresses corresponding to the pulse patterns contain pre-determined values corresponding to the amount and direction of displacement of diaphragm 102 that cause such a pulse pattern. FIG. 4 illustrates a portion of look-up table 150 in DSP 141 and a portion of memory 143. For example, pulse pattern 1000100010001 is associated with memory address A100. As shown in FIG. 4, the memory location at memory address A100 contains a value of 0 displacement, which is the amount of displacement of diaphragm 102 from its initial position to produce the pulse pattern. Similarly pulse pattern 1001001001001 is associated with memory address A101, which contains a value of +1 displacement, corresponding to the 1 position of diaphragm 102 illustrated in FIG. 3. Note also in FIG. 4 that the illustrated portion of look-up table 150 has an entry for pulse pattern 11001100110011. This type of pattern will result from diaphragm 102 being in a position between position 0 and position 1, resulting in light beam 105 hitting sensor 131 in such a way that a portion of the beam hits two sensing elements 132 of sensor 131. Such a pulse pattern is associated with memory address A100 or other appropriate address in look-up table 150. This introduces an element of advantageous additional resolution into the digital signal to compensate for the discrete nature of digital systems. In other words regardless of where diaphragm 102 is, the microphone assigns one of the discrete position values associated with a pulse pattern in the digital representation. Diaphragm 102 travels only a slight distance in either direction, and a large number of discrete positions can be stored in a memory which takes up relatively little space. Therefore, by having a large number of discrete positions stored in memory, the distortion introduced by digitizing the diaphragm's position can be minimized. The angle theta and the number n of elements in sensor 131 are optimized to the application at hand. In general, more elements increases resolution as does reducing angle theta for a more nearly grazing incidence on the reflecting surfaces.

In summary, each position of diaphragm 102, relative to mirror surface 111 causes light beam 105 to hit sensor 131 at differently spaced spatial intervals and positions, thus producing pulse patterns corresponding to the relative position of the diaphragm. The pulse patterns are associated with a value corresponding to the relative position of diaphragm 102 required to cause the pulse pattern. In this way vibration of diaphragm 102 in response to sound waves is converted directly to a digital representation. As diaphragm 102 vibrates, its position relative to mirror surface 111 continuously changes, resulting in continually changing pulse patterns. DSP 141 samples or clocks in the pulse patterns from sensor 131 rapidly enough to gain an accurate digital representation of the original sound signal. Typically, the Nyquist rate, defined as twice the frequency of the highest signal component to be digitized, is sufficient to provide adequate digital signal representation. Advantageously, the sampling rate should be at or above 40 Khz to allow resolution of audio signals up to 20 Khz. Lower or high sampling rates can be used effectively also.

The resulting digital signal can be stored to memory such as a magnetic tape medium, or can be fed to a digital audio system such as a digital audio tape recording unit or to a broadcast system such as an amplifier and speaker unit. Advantageously, the digital signal is digitally filtered (such as by Finite Impulse Response, FIR or Infinite Impulse Response, IIR digital filtering) and modified to filter out unwanted noise elements such as wind noise or background noise. Any distortion introduced into the signal by the transfer characteristics of flexible mounting members 104 can also be compensated for by digital filtering. One way to perform the filtering is to determine the transfer function of connecting elements 104 and the associated error in the response of diaphragm 102 by experiment or other means. Once the transfer function has been determined, a program for cancelling out the error factor introduced by the transfer function can be stored in the program memory of DSP 141 or in memory 143. Special effects such as echo and reverberation can be digitally introduced onto the acoustical signal by a preferred embodiment microphone and suitably programmed DSP, without requiring any additional circuitry, resulting in savings in cost and hardware complexity. Advantageously, all the digital filtering can be performed by DSP 141, thereby reducing the amount of hardware required.

Figure 5:
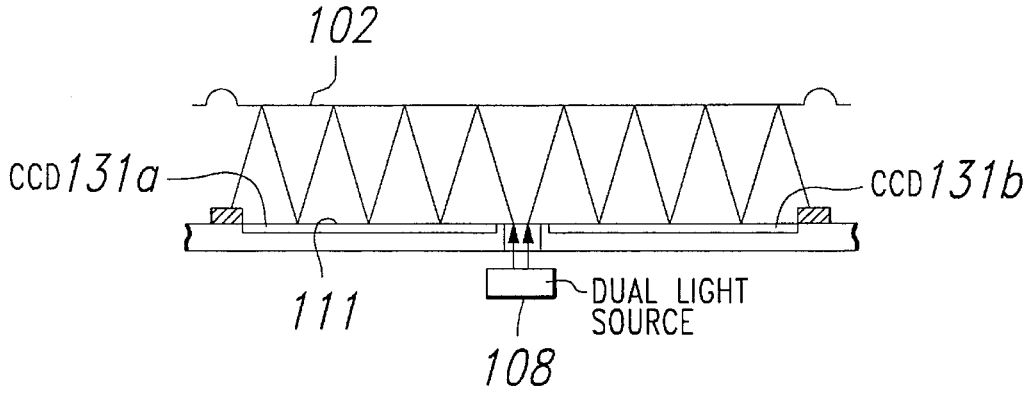
FIG. 5 is a cross-section diagram of the first preferred embodiment microphone having a dual light source.

Light source 108 can be a lone source as illustrated in FIG. 1, or a dual light source as illustrated in FIG. 5 which directs two light beams onto diaphragm 102. The dual light beams are reflected back onto mirror surface 111 and dual sensors 131*a* and 13l*b*. In such an arrangement, the pulse patterns output by sensors 131*a* and 13l*b* can be compared by DSP 141. Differences in the pulse patterns can be caused by distortion of diaphragm 102 or by standing waves which might develop in the diaphragm. DSP 141 produces an error signal from the differences in the pulse patterns of sensors 131*a* and 13l*b* which can be digitally filtered from the digital signal to compensate for signal noise caused by distortion or standing waves in diaphragm 102. In an alternative approach, the light sources are oriented to produce distinct pulse patterns on sensors 131*a* and 13l*b*. The two pulse patterns are both converted to displacements which are averaged or otherwise reconciled by DSP operations to produce the output signal value.

Advantageously, light source 108 of FIGS. 1 and 5 can be a simple light emitting diode (LED) of the type well known in the art, or alternatively, an AlGaAS heterojunction laser fabricated directly on the surface of semiconductor chip 128. Microscopic reflector or refractor elements direct the two light beams to complete the dual light source.

Figure 6:
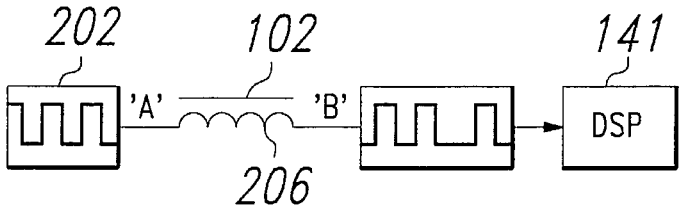
FIG. 6 is a block diagram of a second preferred embodiment microphone.

FIG. 6 illustrates a second preferred embodiment microphone which uses variable inductance to introduce a delay value into a string of regularly spaced pulses. Pulse generator 202 can be a digital clock oscillator circuit, for instance. Pulse generator 202 outputs a string of uniform, regularly spaced digital pulses. The output of pulse generator 202 passes through inductor 206 which is slightly spaced from diaphragm 102. As diaphragm 102 vibrates in response to sound waves hitting it, the distance between the diaphragm and inductor 206 varies. In the second preferred embodiment, diaphragm 102 is ferro-magnetic and the inductance of inductor 200 varies with the distance between inductor 200 and diaphragm 102. This change in inductance value cases a change in the amount of delay introduced into signal A.

In an alternative preferred embodiment, inductor 206 is replaced with one plate of a capacitor comprising diaphragm 102 as the other plate. As diaphragm 102 vibrates in response to sound waves hitting it, the distance between the two plates varies, thus varying the capacitance. The effect of the varying capacitance on a known signal can be analyzed similarly to the effect of varying inductance on a signal, as discussed below.

Figure 6A:
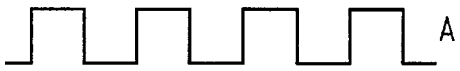
FIGS. 6A–6C are timing diagrams of the signals of the second preferred embodiment of FIG. 6.
Figure 6B:
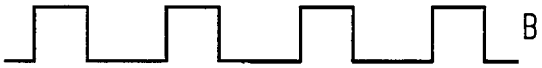
Figure 6C:
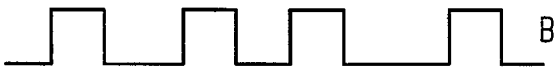

FIG. 6A illustrates a timing diagram of signal A output by pulse generator 202 of FIG. 6. FIG. 6B illustrates a timing diagram of signal B which is the same signal as signal A after it has passed through inductor 206 when diaphragm 102 is at its initial rest position 0. Because diaphragm 102 is at rest, the amount of delay between the pulses of FIG. 6B is constant and is the same as in FIG. 6A. However, the pulses of FIG. 6B are all shifted in time because they are delayed. FIG. 6C illustrates signal B in the case where diaphragm 102 is vibrating in response to sound waves hitting the diaphragm. As diaphragm 102 vibrates, the inductance of the inductor 206 varies due to the diaphragm, thus varying the amount of delay introduced into the pulse string of signal A. Signal B is fed into DSP 141 where a counter, configured to start on the falling edge of a pulse and to stop on the rising edge of the next pulse, determines the amount of delay introduced by inductor 206. Repeated counting operations produce a succession of delay counter values that are proportioned to velocity. In FIG. 6D, the counter values are integrated by the DSP to yield the displacement, with the constraint that their average is zero over an interval such as 100 milliseconds. The counter value corresponding to displacement zero is subtracted by the DSP before integrating to avoid introducing a DC offset. In a still further alternative embodiment, each successive counter value is subtracted from its predecessor to yield an acceleration measurement. The acceleration is suitably output directly, and integrated once for velocity measurement and integrated twice to obtain displacement values. In this way a digital signal is generated corresponding directly to the relative position of diaphragm 102 in relation to inductor 206.

Figure 7:
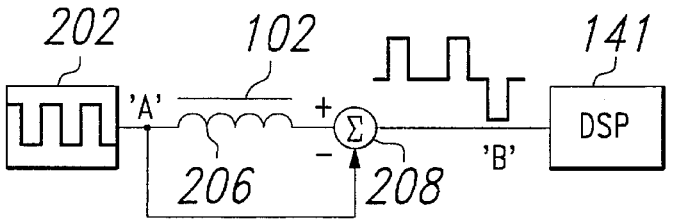
FIG. 7 is a block diagram of a third preferred embodiment microphone.

FIG. 7 illustrates a third preferred embodiment. As in the second preferred embodiment, pulse generator 202 generates a pulse string of uniformly spaced pulses which are output to inductor 206, which introduces a delay into the pulse string proportional to the relative distance between inductor 206 and diaphragm 102. Additionally, the third preferred embodiment includes summing circuit 208 which has two inputs. The non-inverting input of summing circuit 208 is fed by the pulse string that has passed through inductor 206. The inverting input (−) of summing circuit 208 is fed directly from the output of pulse generator 202. The output from summing circuit 208 feeds DSP 141 wherein a digital signal corresponding to the motion of diaphragm 102 is realized as explained in detail below.

Figure 7A:
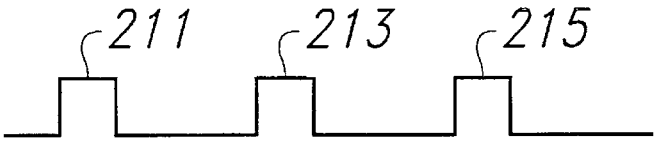
FIGS. 7A–7B are timing diagrams of the signals of the third preferred embodiment of FIG. 7.
Figure 7B:
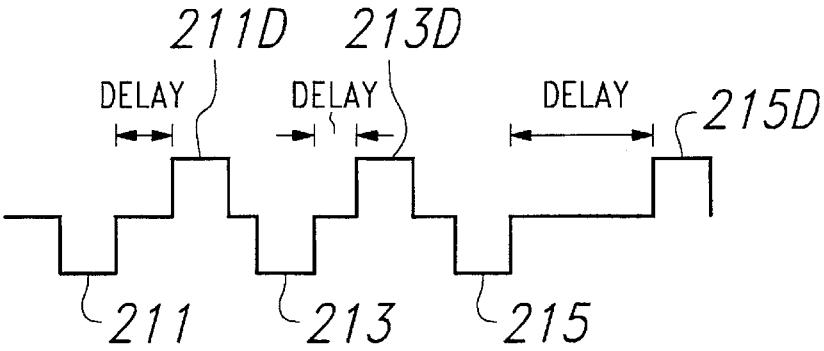

FIG. 7A illustrates a timing diagram of signal A, the pulse string output by pulse generator 202. Pulses 211, 213, and 215 are shown as representative pulses. FIG. 7B illustrates a timing diagram of the output from summing circuit 208 at position B in FIG. 7. Signal B includes undelayed pulses 211, 213, and 215, which have been inverted by the inverting input of summer 208, and also includes delayed pulses 211D, 213D, and 215D, which have been delayed by passing through inductor 206 before feeding the noninverting input of summing circuit 208. This signal is then input to DSP 141.

Figure 8:
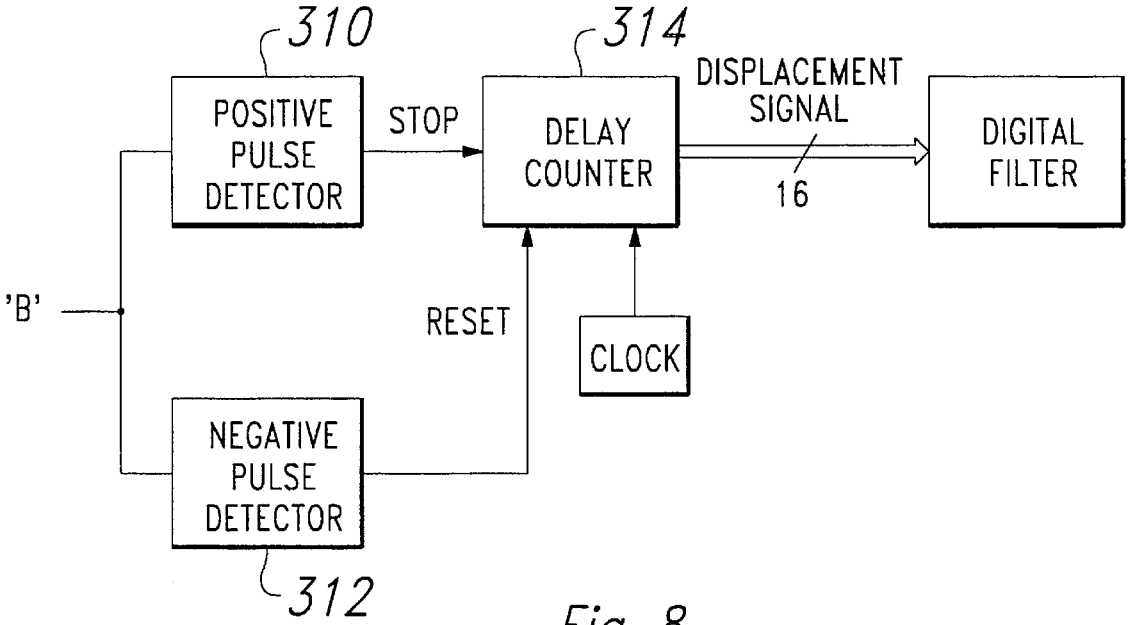
FIG. 8 is a block diagram of the DSP portion of the third preferred embodiment microphone of FIG. 7.

FIG. 8 illustrates the analysis of signal B performed in DSP 141. The signal is fed to positive pulse detector 310 and negative pulse detector 312. When negative pulse detector 312 detects a negative pulse it signals the RESET input of delay measuring counter 314. Counter 314 counts high frequency clock pulses until its STOP input is signaled by positive pulse detector 310 detecting a positive pulse in signal B. For example, when inverted pulse 211 is detected, negative pulse detector 312 signals delay measuring counter 314 to reset to zero and start counting. Counter 314 continues counting until non-inverted delayed pulse 211D triggers positive pulse detector 310 to signal delay measuring counter 314 to stop. The resulting value output by delay measuring counter 314 corresponds to the amount of delay introduced into signal A by inductor 206, which is inversely proportional to the distance between inductor 206 and diaphragm 102. The following inverted pulse 213 will cause counter 314 to again reset to zero and start counting until non-inverted delayed pulse 213D triggers counter 314 to stop at which point the next value is output. The output signal of counter 314 provides a digital representation of the motion of diaphragm 102 caused by the original acoustical signal making diaphragm 102 vibrate. Determined by the amount of delay imposed upon pulse string A, the signal output from counter 314 is related to the diaphragms displacement and independent of the original pulse form of signal A itself. The diagram of FIG. 8 is equally representative of software or hardware implementations of this embodiment.

Note that even at its initial motionless position, diaphragm 102 affects or contributes to the inductance of inductor 206, thus causing steady state level of delay to signal A. Advantageously this steady state level can be subtracted from the output signal of counter 314. In this way the resulting signal equals the delta (or change) from the average or steady state delay. This signal can then be digitally filtered to remove unwanted noise or distortion signals, as discussed above in reference to the first preferred embodiment.

In summary, diaphragm 102 vibrates in response to incoming sound waves of an original acoustical signal to be recorded or broadcast. The influence diaphragm 102 has on a uniform string of energy pulses is analyzed and digitally recorded. In this way the original audio signal is converted directly into a digital representation without the distortion caused by recording the signal with analog techniques and the further distortion caused by converting the analog signal to a digital signal.

Figure 9:
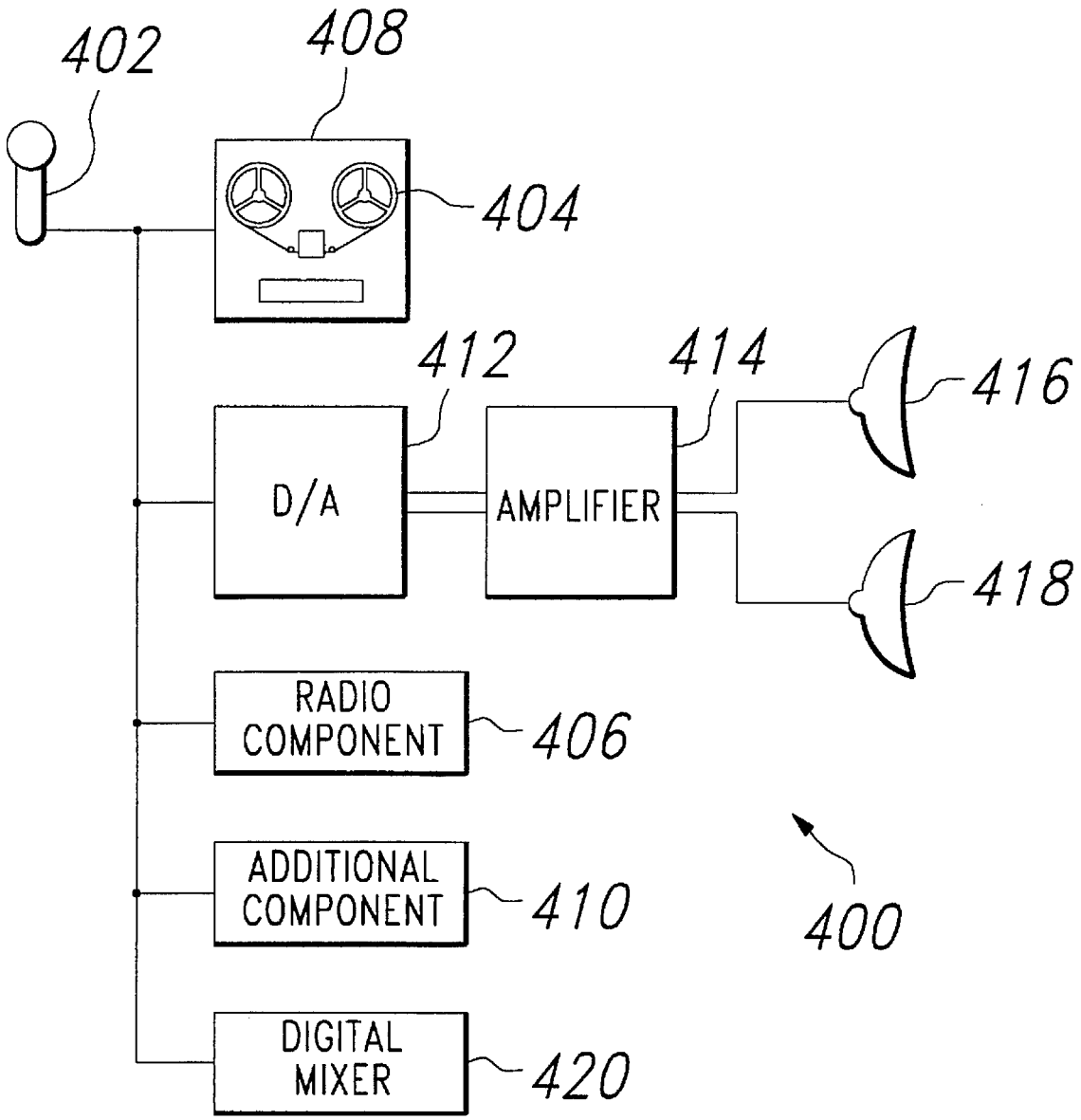
FIG. 9 is a block diagram of a preferred audio system preferred embodiment.

Any of the above described preferred embodiment microphones can provide improved sound recording and reproduction. For instance, FIG. 9 illustrates an audio system 400, which includes microphone 402, storage medium 404, radio component 406, digital tape unit 408, additional component 410, digital to analog converter (D/A) 412, amplifier 414, and loudspeakers 416 and 418. Microphone 402 is of the improved type described in any of FIGS. 1, 2, 5, 6 and 7 and converts an audio signal directly into a digital signal. The digital signal can be in either parallel or serial digital form as convenience dictates. The digital signal can be fed directly to D/A 412 and thence to amplifier 414 and thence to loudspeakers 416 and 418 or can be fed to tape input 408 for permanent storage on storage medium 404. Unit 408 is preferably a digital audio tape (DAT) recorder of a type well known in the art. Output from radio component 406 and component 410, which is preferably a compact disc (CD) player can also be fed directly to either D/A 412 or to additional component DAT recorder 408. With the exception of radio broadcasts received by radio component 406, which are preferably subsequently converted to digital signals, all other signals of the preferred embodiment audio system are digital with the concomitant advantages in signal clarity and hardware simplicity over prior art analog audio systems. A further advantage is that no additional A/D circuitry or filtering circuitry is required to prepare the audio signal received by microphone 402 for compatibility with the other digital components because the circuitry is included with microphone 402 itself.

Additionally or alternatively, audio system 400 may include digital mixer 420. Digital signals from microphone 402, as well as from additional components 408–410, and radio component 406, if in digital form, can be fed directly to the inputs of digital mixer 420. These various signals can then be mixed, while still in digital form prior to being output by digital mixer 420 to D/A 412 or to additional component 408 for permanent storage. In this way, the distortion associated with converting digital signals to analog prior to mixing, and then converting the mixed signals back to digital for storage is avoided, resulting in improved signal quality.

Although the present invention is described by reference to several preferred embodiments, the embodiments are not meant to limit the scope of the invention. Processors can be implemented in microcomputers or microprocessors, in programmed computing circuits, or entirely in hardware or otherwise using technology now known or hereafter developed. For instance, measurement apparatus for measuring distance, velocity and acceleration can be improved by using the above disclosed techniques, by analyzing the influence of a moving object to be measured on a known signal. Automotive air bag actuator systems could also be realized which sense excessive acceleration or deceleration and triggers air bag deployment using the above described techniques. Other applications include detectors on light aircraft wings to measure distortion of the wing and thus air pressure—connected to a processor which determines how much of the wing is "flying" or providing lift, thus to sense incipient stall in flight. Additionally an automotive manifold pressure sensor using the above teachings advantageously determines the vacuum or pressure in the intake system of automobile engine, using a metal diaphragm, thus eliminating the need for analog to digital conversion as the art currently requires. Another application is a digital scale which provides a direct digital output in response to the movement of a pressure plate in response to an object to be measured being placed upon it. It is therefore intended that the appended claims encompass any such modifications or embodiments.

What is claimed is:

1. An apparatus for detecting relative displacement of a diaphragm, comprising:

a signal source for providing a predetermined signal having a string of regularly spaced pulses;

a structure for receiving and distorting said predetermined signal in response to relative displacement of said diaphragm to produce a distorted signal, said structure for receiving and distorting said predetermined signal distorts said signal by distorting the relative phase of said regularly spaced pulses;

a processor for receiving said distorted signal and determining said relative displacement from said distorted signal;

memory circuits connected to said processor for storing instructions for said processor; and additional memory circuits connected to said processor for storing displacement values corresponding to predetermined levels of signal distortion;

said diaphragm is flexibly connected to said base by a connecting element having a determinable transfer function, said transfer function introducing an error factor in the displacement of said diaphragm in response to an external pressure;

said displacement values stored in said memory represent a pressure value corresponding to said external pressure; and said processor including instructions stored in said memory for canceling out said error factor so that a truer estimate of said external pressure is determined.

2. The apparatus of claim 1, wherein said predetermined signal is an electrical signal; and said structure for receiving and modifying said predetermined signal is an electrical circuit having a variable inductance value determined by said diaphragm.

3. The apparatus of claim 1, wherein said predetermined signal is an electrical signal; and said structure for receiving and modifying said predetermined signal is an electrical circuit having a variable capacitance value determined by said diaphragm.

* * * * *